US011622902B2

(12) United States Patent
Laranjeira

(10) Patent No.: US 11,622,902 B2
(45) Date of Patent: Apr. 11, 2023

(54) BIODEGRADEABLE BURIAL CONTAINER

(71) Applicant: Karen Laranjeira, Lafayette, CA (US)

(72) Inventor: Karen Laranjeira, Lafayette, CA (US)

( * ) Notice: Subject to any disclaimer, the term of this patent is extended or adjusted under 35 U.S.C. 154(b) by 0 days.

(21) Appl. No.: 17/408,438

(22) Filed: Aug. 22, 2021

(65) Prior Publication Data

US 2023/0056026 A1 Feb. 23, 2023

(51) Int. Cl.
*A61G 17/007* (2006.01)

(52) U.S. Cl.
CPC ..... *A61G 17/007* (2013.01)

(58) Field of Classification Search
CPC ..... A61G 17/00; A61G 17/08; A61G 17/007; A61G 2203/90; E04H 13/00; E04H 13/008
USPC ..... 27/1, 2, 3, 35
See application file for complete search history.

(56) References Cited

U.S. PATENT DOCUMENTS 4,977,652 A * 12/1990 Graham ..... E04H 13/006 27/35
5,239,733 A * 8/1993 Vail, III ..... A61G 17/0106 27/1
5,636,418 A * 6/1997 Vail, III ..... A61G 17/08 27/1
5,701,642 A * 12/1997 Order ..... E04H 13/00 27/2
5,799,488 A * 9/1998 Truong ..... C05F 1/005 47/1.01 R
5,815,897 A * 10/1998 Longstreth ..... E04H 13/003 47/79
6,516,501 B2 * 2/2003 Vazquez-Perez ..... E04H 13/00 27/1
7,636,991 B1 * 12/2009 Scalisi, III ..... E04H 13/00 27/35
7,665,195 B1 * 2/2010 Vazquez-Perez ..... A61G 17/08 27/1
9,261,598 B1 * 2/2016 Robinson ..... E04H 13/008
9,756,775 B2 * 9/2017 Bibaud ..... A01C 1/046
10,123,926 B2 * 11/2018 Brewer ..... A61G 17/0073
10,813,819 B2 * 10/2020 Lieberstein ..... A61G 17/08
2002/0032954 A1 * 3/2002 Vazquez-Perez ..... E04H 13/00 27/1
2015/0067997 A1 * 3/2015 Biller ..... H04L 63/1441 27/13
2015/0264869 A1 * 9/2015 Steiner ..... A61G 17/08 47/66.6
2016/0000002 A1 * 1/2016 Bibaud ..... A01G 24/15 264/153
2016/0296403 A1 * 10/2016 Brewer ..... E04H 13/008

FOREIGN PATENT DOCUMENTS

EP 1588684 A1 * 10/2005 ..... A61G 17/0073
GB 2506463 A * 4/2014 ..... E04H 13/00
WO WO-2011078640 A2 * 6/2011 ..... A61G 17/007

* cited by examiner

*Primary Examiner* — William L Miller
(74) *Attorney, Agent, or Firm* — The Iwashko Law Firm, PLLC; Lev Ivan Gabriel Iwashko

(57) ABSTRACT

A biodegradable burial container to be disposed under a ground surface at roots of a plant, the biodegradable burial container including a main body to receive a corpse therein and decompose the corpse in response to contact with the corpse, such that the decomposition of the corpse nourishes the plant, and a vegetation layer disposed within at least a portion of the main body to retain moisture within the main body.

3 Claims, 1 Drawing Sheet

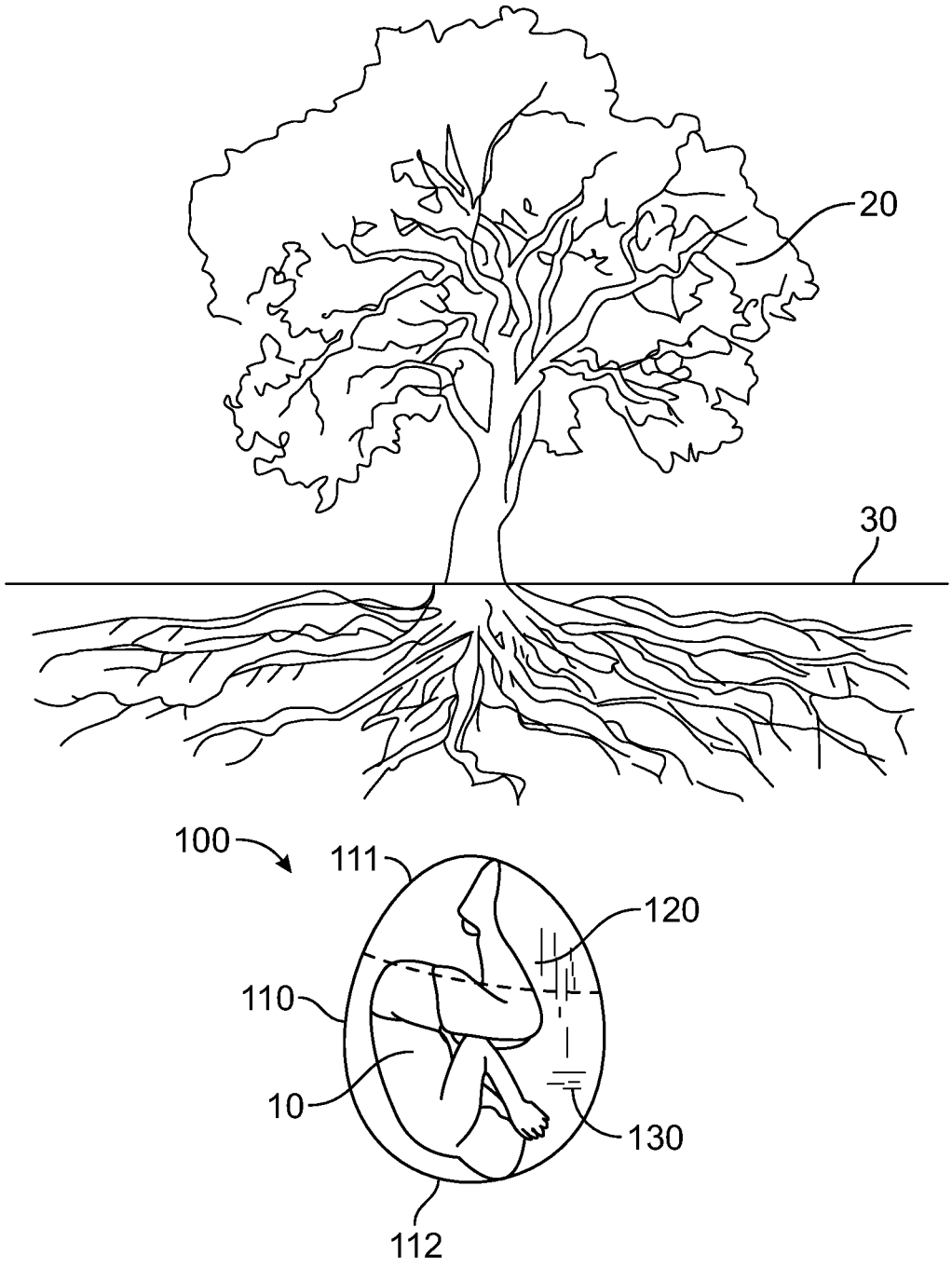
20
30
100
111
120
110
10
130
112

BIODEGRADEABLE BURIAL CONTAINER

BACKGROUND

1. Field

The present general inventive concept relates generally to a container, and particularly, to a biodegradable burial container.

2. Description of the Related Art

Standard burial and/or cremation services use vast amounts of energy and resources, which pose a serious threat to the environment. In particular, burial and cremation services use toxic chemicals for embalming that can dissipate into the air and/or soil. As such, the toxic chemicals leave a significant footprint on the environment that harm both plant and animal life.

Additionally, burial vaults are often constructed of concrete and/or metal. Conversely, coffins and/or caskets are usually constructed of wood. The burial vault is used to store the coffin and/or the casket to prevent the ground from sinking after the coffin and/or the casket collapses. As such, the burial vault does not decompose and harms the environment.

Therefore, there is a need for a biodegradable burial container that facilitates decomposition of a body.

SUMMARY

The present general inventive concept provides a biodegradable burial container.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a biodegradable burial container to be disposed under a ground surface at roots of a plant, the biodegradable burial container including a main body to receive a corpse therein and decompose the corpse in response to contact with the corpse, such that the decomposition of the corpse nourishes the plant, and a vegetation layer disposed within at least a portion of the main body to retain moisture within the main body.

The main body may be constructed of mycelium to decompose the corpse.

The vegetation layer may use Spanish moss to absorb moisture from air.

The biodegradable burial container may further include a decomposition unit disposed within at least a portion of the main body to increase a speed of decomposition of the corpse in response to dispensing a plurality of compost microbes and a plurality of wood chips into the main body.

BRIEF DESCRIPTION OF THE DRAWINGS

These and/or other features and utilities of the present generally inventive concept will become apparent and more readily appreciated from the following description of the embodiments, taken in conjunction with the accompanying drawings of which:

FIG. 1 illustrates a sectional view of a biodegradable burial container, according to an exemplary embodiment of the present general inventive concept.

DETAILED DESCRIPTION

Various example embodiments (a.k.a., exemplary embodiments) will now be described more fully with reference to the accompanying drawings in which some example embodiments are illustrated. In the FIGURES, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Biodegradable Burial Container 100
Main Body 110
First Section 111
Second Section 112
Vegetation Layer 120
Decomposition Unit 130

FIG. 1 illustrates a sectional view of a biodegradable burial container 100, according to an exemplary embodiment of the present general inventive concept.

The biodegradable burial container 100 may be constructed from at least one of organic material and wood, etc., but is not limited thereto.

The biodegradable burial container 100 may include a main body 110, a vegetation layer 120, and a decomposition unit 130, but is not limited thereto.

Referring to FIG. 1, the main body 110 is illustrated to have an egg shape. However, the main body 110 may be rectangular, circular, conical, triangular, pentagonal, hexagonal, heptagonal, octagonal, or any other shape known to one of ordinary skill in the art, but is not limited thereto.

The main body 110 may include a first section 111 and a second section 112, but is not limited thereto.

The main body 110 may be constructed of mycelium (i.e., a fungus). Moreover, the main body 110 may be separated into the first section 111 and/or the second section 112. In other words, the first section 111 may be detachably connected to at least a portion of the second section 112, such that removing the first section 111 from the second section 112 may facilitate access within the first section 111 and/or the second section 112. The main body 110 may receive a corpse 10 of a deceased therein. As such, the main body 110 may store the corpse 10 therein.

Furthermore, the mycelium of the main body 110 may decompose the corpse 10 in response to contact with the corpse 10. Additionally, the mycelium of the main body 110 may form compostable material and/or detoxify the corpse 10 to fertilize and/or nourish a plant 20 (e.g., a tree, a bush, a shrub, etc.) rooted under a ground surface 30 and connected to the main body 110. Accordingly, the main body 110 may be inserted under the ground surface 30 and disposed near roots of the plant 20, such that the plant 20 may receive nutrients from the main body 110 in response to the decomposition of the corpse 10.

The vegetation layer 120 may include a bromeliad and an epiphytic plant, but is not limited thereto.

The vegetation layer 120 may be disposed within at least a portion of an interior of the main body 110. The vegetation layer 120 may cushion the corpse 10 within the main body 110 and retain moisture within the main body 110. For example, the vegetation layer 120 may be Spanish moss, which is capable of absorbing water from air. As a result, the Spanish moss of the vegetation layer 120 may facilitate decomposition by the mycelium of the main body 110 due to an increase in a moisture level within the main body 110.

The decomposition unit 130 may include a permeable body (e.g., a permeable container), a plurality of wood chips, and a plurality of compost microbes, but is not limited thereto.

The decomposition unit 130 may be disposed within at least a portion of the main body 110. The decomposition unit 130 may dispense the plurality of wood chips and/or the plurality of compost microbes through the permeable body into the interior of the main body 110. Moreover, each of the plurality of compost microbes may include aerobic bacteria, thermophilic bacteria, and actinomycetes, but is not limited thereto. Moreover, the decomposition unit 130 may increase a speed of decomposition in response to release of the plurality of compost microbes due to an affinity of thermophilic bacteria to the plurality of wood chips. As such, the decomposition unit 130 may increase the speed of decomposition of the corpse 10, such that the compostable material may nourish the plant 20.

Therefore, the biodegradable burial container 100 may reduce negative impact to an environment by providing a biodegradable alternative to a burial vault and does not pollute. Also, the biodegradable burial container 100 may improve growth of the plant 20 and/or other lifeforms that receive nutrients from the decomposition of the corpse 10. Thus, the growth of the plant 20 may provide a memory of the deceased.

The present general inventive concept may include a biodegradable burial container 100 to be disposed under a ground surface 30 at roots of a plant 20, the biodegradable burial container 100 including a main body 110 to receive a corpse 10 therein and decompose the corpse 10 in response to contact with the corpse 10, such that the decomposition of the corpse 10 nourishes the plant 20, and a vegetation layer 120 disposed within at least a portion of the main body 110 to retain moisture within the main body 110.

The main body 110 may be constructed of mycelium to decompose the corpse 10.

The vegetation layer 120 may use Spanish moss to absorb moisture from air.

The biodegradable burial container 100 may further include a decomposition unit 130 disposed within at least a portion of the main body 110 to increase a speed of decomposition of the corpse 10 in response to dispensing a plurality of compost microbes and a plurality of wood chips into the main body 110.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A biodegradable burial container to be disposed under a ground surface at roots of a plant, the biodegradable burial container comprising:

a main body to receive a corpse therein for decomposition of the corpse, such that the decomposition of the corpse nourishes the plant;

a vegetation layer disposed within at least a portion of the main body to retain moisture within the main body; and a decomposition unit disposed within at least a portion of the main body to increase a speed of decomposition of the corpse in response to dispensing a plurality of compost microbes and a plurality of wood chips into the main body.

2. The biodegradable burial container of claim 1, wherein the main body is constructed of mycelium to decompose the corpse.

3. The biodegradable burial container of claim 1, wherein the vegetation layer uses Spanish moss to absorb moisture from air.

* * * * *